US012420990B2

(12) United States Patent
Jeong

(10) Patent No.: US 12,420,990 B2
(45) Date of Patent: Sep. 23, 2025

(54) ROTATION TYPE ELEVATING CONTAINER AND OPERATING METHOD THEREOF

(71) Applicant: AMOREPACIFIC CORPORATION, Seoul (KR)

(72) Inventor: Jinsoo Jeong, Yongin-si (KR)

(73) Assignee: Amorepacific Corporation, Seoul (KR)

( * ) Notice: Subject to any disclaimer, the term of this patent is extended or adjusted under 35 U.S.C. 154(b) by 144 days.

(21) Appl. No.: 18/168,861

(22) Filed: Feb. 14, 2023

(65) Prior Publication Data

US 2023/0264863 A1 Aug. 24, 2023

(30) Foreign Application Priority Data

Feb. 16, 2022 (KR) ..... 10-2022-0019919

(51) Int. Cl.

| | |
|---|---|
| ***B65D 25/34*** | (2006.01) |
| ***A45D 34/04*** | (2006.01) |
| ***B65D 25/54*** | (2006.01) |
| ***B65D 41/06*** | (2006.01) |

(52) U.S. Cl.

CPC ..... *B65D 41/06* (2013.01); *A45D 34/04* (2013.01); *B65D 25/34* (2013.01); *B65D 25/54* (2013.01); *A45D 2200/053* (2013.01)

(58) Field of Classification Search

CPC B65D 41/06; B65D 21/0227; B65D 21/0224; A45D 34/04

USPC ..... 215/222

See application file for complete search history.

(56) References Cited

U.S. PATENT DOCUMENTS

| | | | | |
|---|---|---|---|---|
| 8,152,398 | B2 * | 4/2012 | Kim | A45D 40/065 401/60 |
| 11,445,797 | B1 * | 9/2022 | Zheng | B05B 11/1045 |
| 12,060,212 | B2 * | 8/2024 | Kang | A45D 40/24 |
| 2012/0091131 | A1 * | 4/2012 | Arjomand | B65D 7/22 220/4.01 |
| 2017/0065056 | A1 * | 3/2017 | Huang | A45D 40/04 |
| 2017/0196339 | A1 * | 7/2017 | Kim | A45D 40/06 |
| 2017/0348714 | A1 * | 12/2017 | Lee | A45D 34/00 |
| 2018/0263359 | A1 * | 9/2018 | Kim | A45D 19/02 |
| 2021/0274915 | A1 * | 9/2021 | Weiss | A45C 11/00 |
| 2021/0330056 | A1 * | 10/2021 | Lee | A45D 34/04 |
| 2022/0097089 | A1 * | 3/2022 | Jung | A45D 40/26 |
| 2023/0113740 | A1 * | 4/2023 | Min | A45D 34/00 132/200 |

(Continued)

FOREIGN PATENT DOCUMENTS

KR 102308121 B1 * 6/2020

*Primary Examiner* — Anthony D Stashick
*Assistant Examiner* — Symren K Sanghera
(74) *Attorney, Agent, or Firm* — Sughrue Mion, PLLC

(57) ABSTRACT

An aspect of the present disclosure may provide a rotation type elevating container which includes a storage container capable of storing contents; a lower member accommodating a lower portion of the storage container; and an upper member accommodating an upper portion of the storage container and provided to be movable relative to the lower member, wherein the storage container has a first state in which the storage container is concealed from an outside by the upper member and the lower member, and a second state in which the upper member is spaced apart from the lower member so that a portion of the storage container is observable from the outside.

11 Claims, 10 Drawing Sheets

(56) References Cited

U.S. PATENT DOCUMENTS

| | | | | |
|---|---|---|---|---|
| 2023/0172340 | A1* | 6/2023 | Liu | A45D 40/065<br>401/78 |
| 2023/0284766 | A1* | 9/2023 | Kim | A45D 40/06 |

* cited by examiner

ROTATION TYPE ELEVATING CONTAINER AND OPERATING METHOD THEREOF

CROSS-REFERENCE TO RELATED APPLICATION(S)

This application is based on and claims priority of Korean Patent Application No 10-2022-0019919, filed on Feb. 16, 2022 with the Korean Intellectual Property Office, the entire contents of which are hereby incorporated by reference.

TECHNICAL FIELD

The present disclosure relates to a rotation type elevating container and a method for operating a rotation type elevating container.

As users' interest in skin care increases, various forms of cosmetics are being launched.

BACKGROUND

Recently, a kind of cosmetic container having a structure in which a pump is moved up when a lid portion of the cosmetic container is rotated has been released.

In the case of the cosmetic container having a pump which can be moved up, when this container is made transparent so that the contents therein can be seen, there is a problem in that the contents are deteriorated by ultraviolet radiation.

Additionally, when the container is made opaque, there is a problem in that it is difficult to check the remaining amount of the contents.

That is, in the case of a conventional cosmetic container having a pump which can be moved up, it is difficult to realize a function of allowing a user to check the remaining amount of the contents while at the same time effectively blocking ultraviolet radiation to the contents.

An object of the present disclosure is to provide a rotation type elevating container and a method for operating a rotation type elevating container, which enable a user to check the remaining amount of the contents while at the same time blocking ultraviolet radiation to the contents.

Additionally, another object of the present disclosure is to provide a rotation type elevating container and a method for operating a rotation type elevating container, which are capable of providing increased usage convenience.

DOCUMENT OF RELATED ART

Patent Document

Patent document: Korean Patent No. 10-2308121 B1 (Sep. 27, 2021)

SUMMARY

The examples of the disclosure, which have been conceived to address above-described problems, are to provide a rotation type elevating container and a method for operating a rotation type elevating container, which enable a user to check the remaining amount of the contents while at the same time blocking ultraviolet radiation to the contents.

Additionally, another object of the present disclosure is to provide a rotation type elevating container and a method for operating the same, which are capable of providing improved usage convenience.

According to an aspect of the present invention, there is provided a rotation type elevating container comprising: a storage container capable of storing contents; a lower member accommodating a lower portion of the storage container; and an upper member accommodating an upper portion of the storage container and provided to be movable relative to the lower member, wherein the storage container has: a first state in which the storage container is concealed from an outside by the upper member and the lower member; and a second state in which the upper member is spaced apart from the lower member so that a portion of the storage container is observable from the outside.

Further, there is provided a rotation type elevating container, wherein the storage container includes: a storage container upper part provided with a discharging hole through which the contents can be discharged; a storage container middle part provided with a rotation prevention part for preventing rotation of the storage container relative to the upper member; and a storage container lower part provided with a first guide part which is slidably moved in contact with a first projection of the lower member.

Further, there is provided a rotation type elevating container, wherein the outer side of the storage container is provided with a first guide part that is a path along which a first projection of the lower member is moved, and wherein the first guide part includes a first inclined path forming a first angle with a horizontal plane; a first flat path extending from one side of the first inclined path and parallel to the horizontal plane; and a second flat path extending from another side of the first inclined path and parallel to the first flat path.

Further, there is provided a rotation type elevating container, wherein the lower member includes an outer lower member provided with a first projection in contact with a portion of the storage container; and an inner lower member provided with a second guide part for guiding a second projection of the upper member.

Further, there is provided a rotation type elevating container, wherein the second guide part includes: a second inclined path forming a second angle with a horizontal plane; a third flat path extending from one side of the second inclined path and parallel to the horizontal plane; and a fourth flat path extending from another side of the second inclined path and parallel to the third flat path.

Further, there is provided a rotation type elevating container, wherein the storage container is provided with a first guide part with which a first projection of the lower member is slidably moved in contact, wherein the lower member is provided with a second guide part that is a path along which a second projection of the upper member is moved, wherein the first guide part includes a first inclined path forming a first angle with a horizontal plane, and the second guide part has a second inclined path forming a second angle with a horizontal plane, and wherein the first angle is provided greater than the second angle.

Further, there is provided a rotation type elevating container, wherein at least a portion of the inner lower member is provided in a transparent material.

Further, there is provided a rotation type elevating container, wherein when the upper member and the storage container are rotated by a same angle with respect to the lower member, a height by which the storage container is moved in a vertical direction is provided greater than a height by which the upper member is moved in a vertical direction.

Further, there is provided a rotation type elevating container, wherein a first fixing part provided as a plurality of slits is formed on the inner side of the outer lower member, wherein a second fixing part provided as a plurality of slits is formed on the outer side of the inner lower member, and wherein the first fixing part and the second fixing part are coupled so that the outer lower member and the inner lower member are relatively fixed.

Further, there is provided a rotation type elevating container, wherein the inner lower member includes a second guide part for guiding the movement of the upper member.

Further, there is provided a rotation type elevating container of claim 1, wherein the upper member includes: a second projection which is moved along a second guide part provided on the inner lower member; and a coupling member that rotates the storage container by being coupled with a rotation prevention part of the storage container.

According to another aspect of the present invention, there is provided a method for operating a rotation type elevating container including a storage container capable of storing contents, a lower member accommodating a lower portion of the storage container, and an upper member accommodating an upper portion of the storage container and provided to be movable relative to the lower member, the method comprising: rotating a second projection of the upper member to be moved up along a second guide part of the lower member (step S1); and supporting a first guide part of the storage container with a first projection provided on the lower member to be moved up as the upper member rotates the storage container (step S2), wherein a height by which the storage container is moved up is provided greater than a height by which the upper member is moved up.

Further, there is provided a method, wherein the step S1 includes moving the second projection along the second guide part having a second angle, wherein the step S2 includes moving a first inclined path having a first angle while supporting the first inclined path with the first projection, and wherein the first angle is provided greater than the second angle.

The rotation type elevating container according to the examples of the present disclosure has the advantage of enabling a user to check the remaining amount of the contents while at the same time blocking ultraviolet radiation to the contents.

Additionally, there is an advantage of providing the improved usage convenience.

DETAILED DESCRIPTION OF EXEMPLARY EMBODIMENTS

Hereinafter, specific exemplary embodiments of the present disclosure will be described in detail with reference to the drawings. Additionally, it is noted that in the description of the disclosure, the detailed description for known related configurations or functions may be omitted when it is deemed that such description may obscure essential points of the disclosure.

Figure 1:
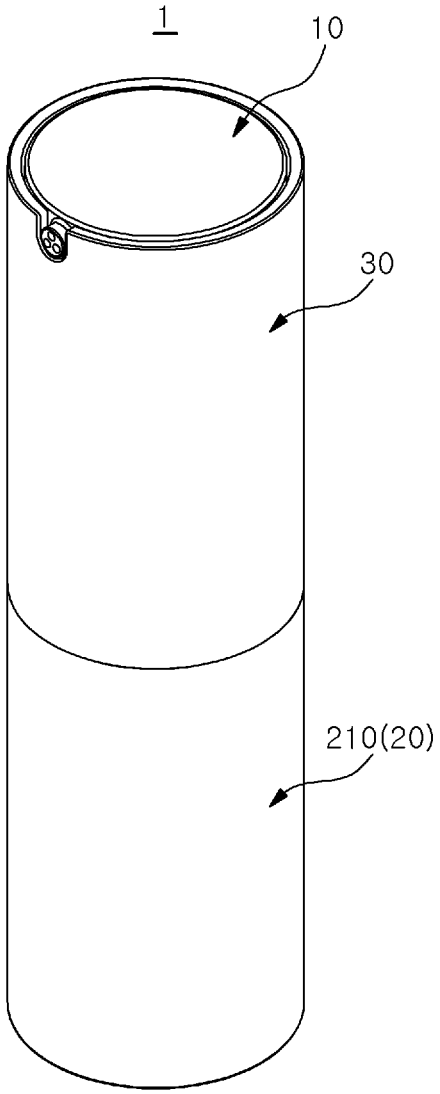
FIG. 1 is a perspective view of a rotation type elevating container according to an embodiment of the present disclosure.
Figure 2:
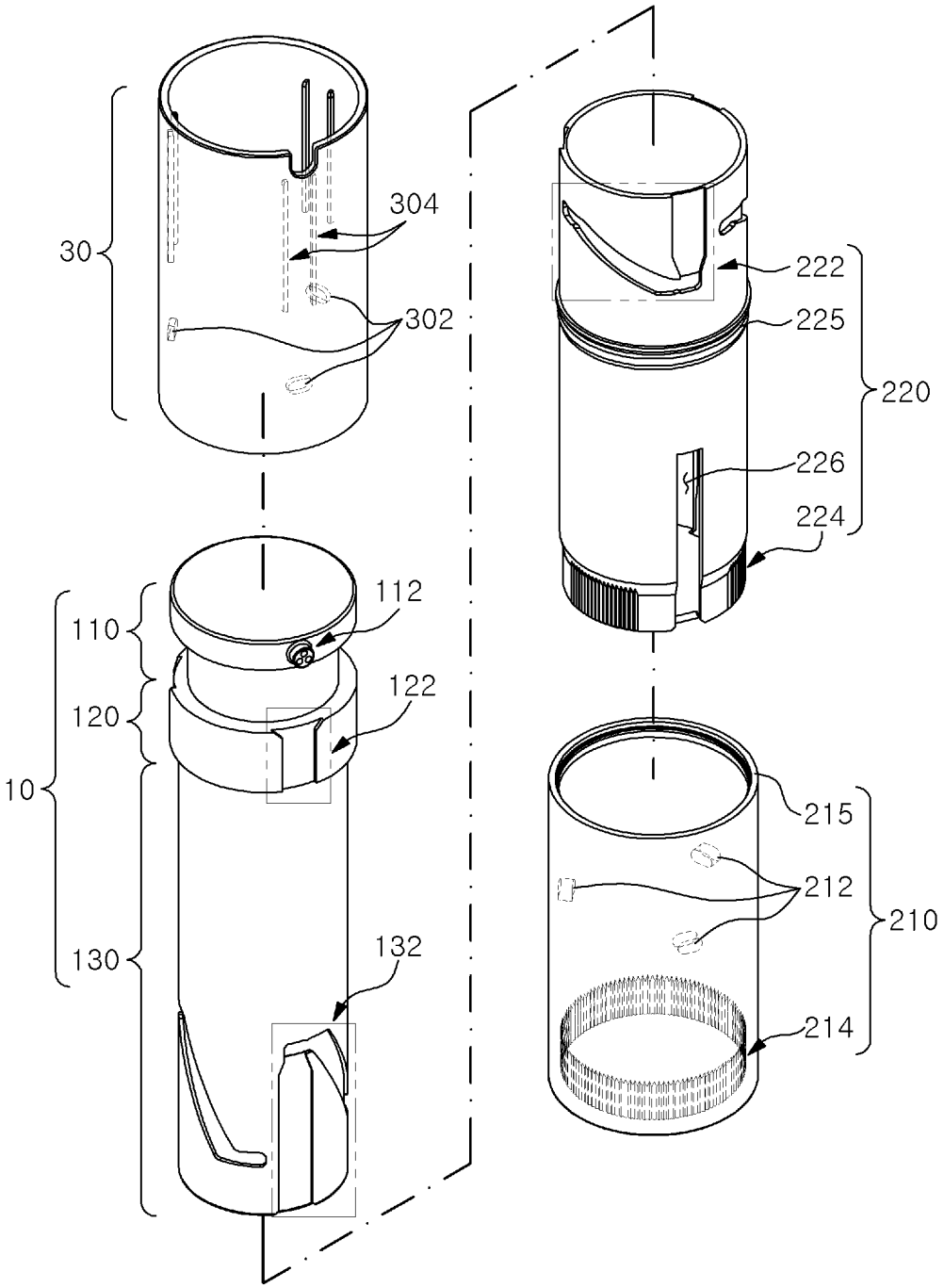
FIG. 2 is an exploded perspective view of the rotation type elevating container of FIG. 1.
Figure 3:
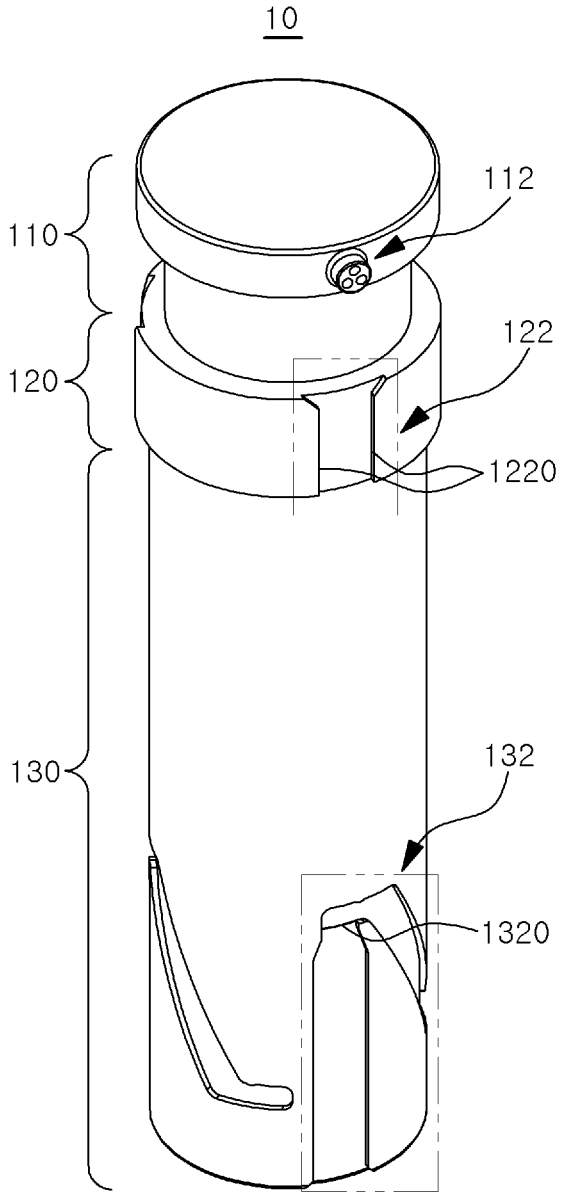
FIG. 3 is a perspective view showing a storage container of FIG. 2 in more detail.
Figure 4:
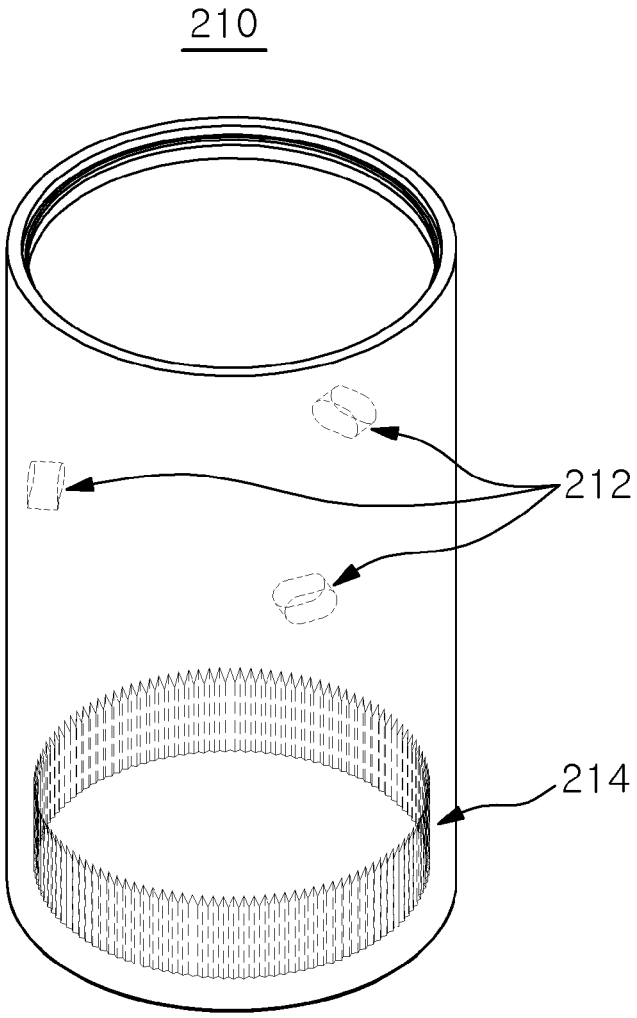
FIG. 4 is a perspective view representing an outer lower member of FIG. 2 in more detail.
Figure 5:
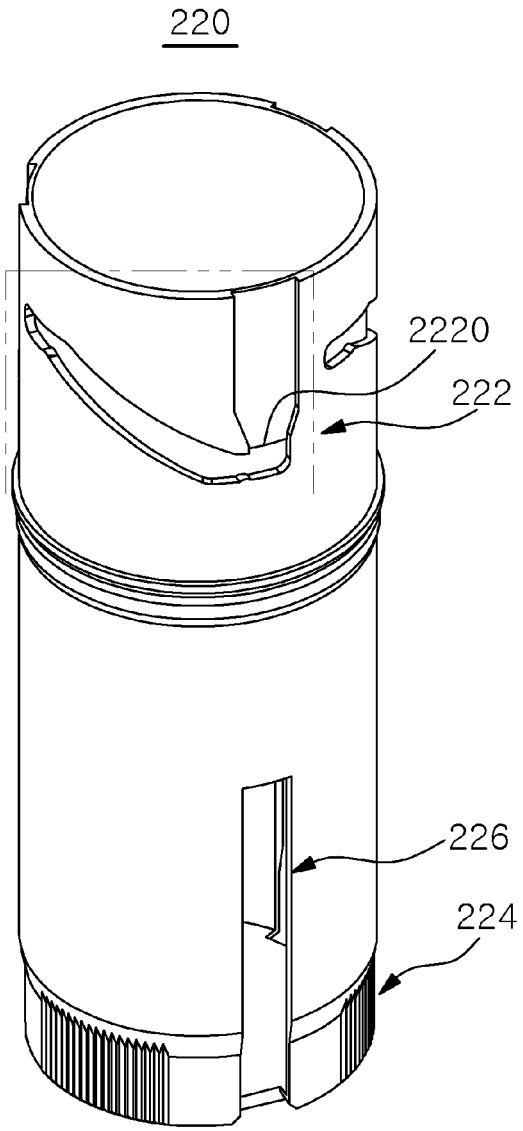
FIG. 5 is a perspective view representing an inner lower member of FIG. 2 in more detail.
Figure 6:
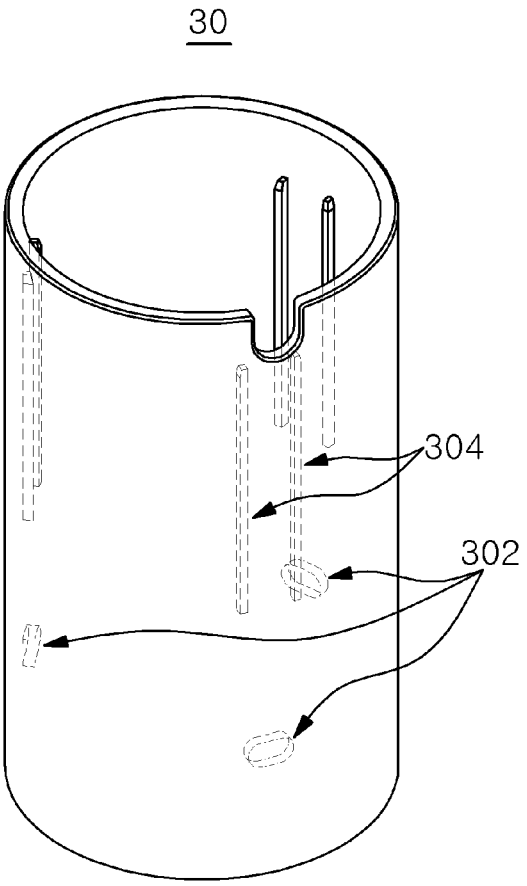
FIG. 6 is a perspective view representing an upper member of FIG. 2 in more detail.

FIG. 1 is a perspective view of a rotation type elevating container 1 according to an embodiment of the present disclosure. FIG. 2 is an exploded perspective view of the rotation type elevating container 1 of FIG. 1. FIG. 3 is a perspective view showing a storage container 10 of FIG. 2 in more detail. FIG. 4 is a perspective view representing an outer lower member 210 of FIG. 2 in more detail. FIG. 5 is a perspective view showing an inner lower member 220 of FIG. 2 in more detail. FIG. 6 is a perspective view representing an upper member 30 of FIG. 2 in more detail.

Referring to FIGS. 1 to 6, the rotation type elevating container 1 according to an embodiment of the present disclosure may include a storage container 10 capable of storing contents; a lower member 20 accommodating a lower portion of the storage container 10; an upper member 30 accommodating an upper portion of the storage container 10 and provided to be movable relative to the lower member 20.

The storage container 10 may have a first state in which it is concealed from the outside by the upper member 30 and the lower member 20 (a state shown in FIG. 9 to be described later); and a second state in which the upper member 30 is spaced apart from the lower member 20 so that a portion of the storage container 10 is observable from the outside (a state shown in FIG. 10 to be described later). A detailed description of this will be given later.

Here, the first state may be understood as a state in which the sides of the storage container 10 excluding a discharging hole 112 are not observable from the outside.

Additionally, the second state may be understood as a state in which a portion of the upper part of the storage container 110 and a portion of the inner lower member 220 are observable from the outside.

In this embodiment, all or a portion of the inner lower member 220 and the portion for storing the contents of the storage container 10 may be formed of a transparent material.

In this case, when the upper member 30 is relatively elevated with respect to the outer lower member 210, the inner lower member 220 is exposed from where the upper member 30 and the outer lower member 210 are relatively spaced apart, and since the exposed inner lower member 220 is formed of a transparent material, the contents stored in the storage container 10 can be visually checked.

The rotation type elevating container 1 may be closed before use. In this case, since the rotation type elevating container 1 is closed before use, it is possible to prevent its contents from being deteriorated by ultraviolet radiation.

Additionally, since the upper member 30 and the outer lower member 210 are spaced apart from each other when the rotation type elevating container 1 is used, a structure allowing a user to check the remaining amount of contents stored in the storage container 10 can be provided.

The rotation type elevating container 1 may store cosmetic material as contents, so it may be referred to as a cosmetic container.

The storage container 10 may be formed in a cylindrical shape with the storage container middle part 120 protruding in the circumferential direction.

The storage container 10 may include a storage container upper part 110 provided with the discharging hole 112 through which contents can be discharged; a storage container middle part 120 provided with a rotation prevention part 122 for preventing the rotation of the storage container relative to the upper member 30; and a storage container lower part 130 provided with a first guide part 132 which is slidably moved in contact with a portion of the lower member 20.

A pump (not shown) may be provided inside the storage container upper part 110 to discharge the contents stored in the storage container lower part 130.

Additionally, when the storage container upper part 110 is pressed by an external force, the pump is subject to the application of the pressure so that the contents can be discharged to the outside through the discharging hole 112.

A plurality of rotation prevention parts 122 may be provided on the outer circumference of the storage container middle part 120 to prevent the rotation of the storage container middle part relative to the upper member 30.

The rotation prevention part 122 may be formed as a groove extending in the vertical direction on the outer circumference of the storage container middle part 120. However, the technical idea of the present disclosure is not limited to this, but when the coupling member 304 of the upper member 30 is provided as a groove, the rotation prevention part 122 may be provided as a corresponding projection.

While the rotation prevention part 122 can allow its vertical movement relative to the upper member 30, it can prevent its rotation relative to the upper member 30.

That is, when the upper member 30 is rotated by an external force, a second projection 302 of the upper member 30 can be moved up along a second guide part 222 to be described later, and the coupling member 304 of the upper member 30 can be moved up while rotating the rotation prevention part 122.

The diameter of the storage container middle part 120 may be provided greater than the diameter of the storage container lower part 130.

The diameter of the storage container middle part 120 may be formed to be the same as that of the inner lower member 220 to be described later. As a result, the upper side of a second projection insertion part 2221 of the second guide part 222 and the lower side of the rotation prevention part 122 can be connected to each other to provide an assembly path along which the second projection 302 is coupled to the second guide part 222.

A space in which contents (e.g., cosmetic material) can be stored may be provided inside the storage container lower part 130.

The storage container lower part 130 may extend downward from the storage container middle part 120, and may include a first guide part 132 sliding in contact with a portion of the lower member 20 (first projection 212).

The first guide part 132 may be supported and moved by the first projection 212 provided on the outer lower member 210. For example, the first projection 212 may be relatively moved along a path formed in the first guide part 132.

A plurality of first guide parts 132 may be provided along the circumference of the storage container lower part 130.

This example is described such that there are three first guide parts 132. However, the technical idea of the present disclosure is not limited to this, but includes a case where there are two or four or more first guide parts 132.

Since the plurality of first guide parts 132 are provided, the storage container can be stably moved with respect to the outer lower member 210.

A more detailed description of the first guide part 132 will be provided below.

The lower member 20 may include the outer lower member 210 including a first projection 212 in contact with a portion of the storage container 10 (the first guide part 132); and the inner lower member 220 including a second guide part 222 contacting a portion of the upper member 30 (the second projection 302).

The outer lower member 210 and the inner lower member 220 may be fixed to each other.

In this embodiment, the outer lower member 210 and the inner lower member 220 are described as being separate members, but the outer lower member 210 and the inner lower member 220 may be formed as one member.

The outer lower member 210 may include a first fixing part 214 for fixing the inner lower member 220; and the first projection 212 that is slid along the first guide part 132.

The first fixing part 214 may be formed along the inner circumference of the outer lower member 210, and may be formed as a plurality of slits. Additionally, the first fixing part 214 may be disposed at the lower side of the outer lower member 210.

The first projection 212 formed on the inside of the outer lower member 210 can be coupled to the first guide part 132 formed on the outside of the storage container 10, and the first projection 212 can be moved relative to the first guide part 132.

In this example, the first guide part 132 may be formed as a groove, and the first projection 212 may be formed as a projection.

However, the technical idea of the present disclosure is not limited to this, but may include a case where the first guide part 132 of the storage container 10 is formed as a projection, and the first projection 212 of the outer lower member 210 is formed as a groove (same shape as the first guide part 132).

The inner lower member 220 may include a second fixing part 224 coupled to the first fixing part 214 of the outer lower member 210; a coupling slit 226 providing a space into which the first projection 212 of the outer lower member 210 is inserted; and the second guide part 222 guiding the movement of the upper member 30.

The second guide part 222 formed as a groove can be coupled to the second projection 302 to guide the movement of the second projection 302.

In this example, the second guide part 222 of the inner lower member 220 is described by way of example as being a groove, and the second projection 302 of the upper member 30 is described by way of example as being a projection.

However, the technical idea of the present disclosure is not limited to this, but it may include a case where the second guide part 222 is a projection, and the second projection 302 formed on the upper member 30 is a groove (same shape as the second guide part 222).

The storage container 10 can be accommodated inside the inner lower member 220.

The inner lower member 220 may be fixed to the inside of the outer lower member 210, and the storage container 10 may be accommodated inside the inner lower member 220 so that it can be moved up and down.

The lower side of the inner lower member 220 may be inserted into the inside of the outer lower member 210 and fixed to the outer lower member 210.

The upper side of the inner lower member 220 may be wrapped by the upper member 30.

At least a portion of the inner lower member 220 is formed of a transparent material.

For example, only a portion of the inner lower member 220 that is not inserted into the outer lower member 210 may be formed of a transparent material. In this case, when the upper member 30 is moved up, the user can check the contents stored in the storage container 10 with the naked eye through a portion of the inner lower member 220 that is not concealed by the upper member 30.

The height of the storage container 10 may be formed greater than the height of the inner lower member 220, and the height of the inner lower member 220 may be formed greater than the height of the outer lower member 210.

Figure 7:
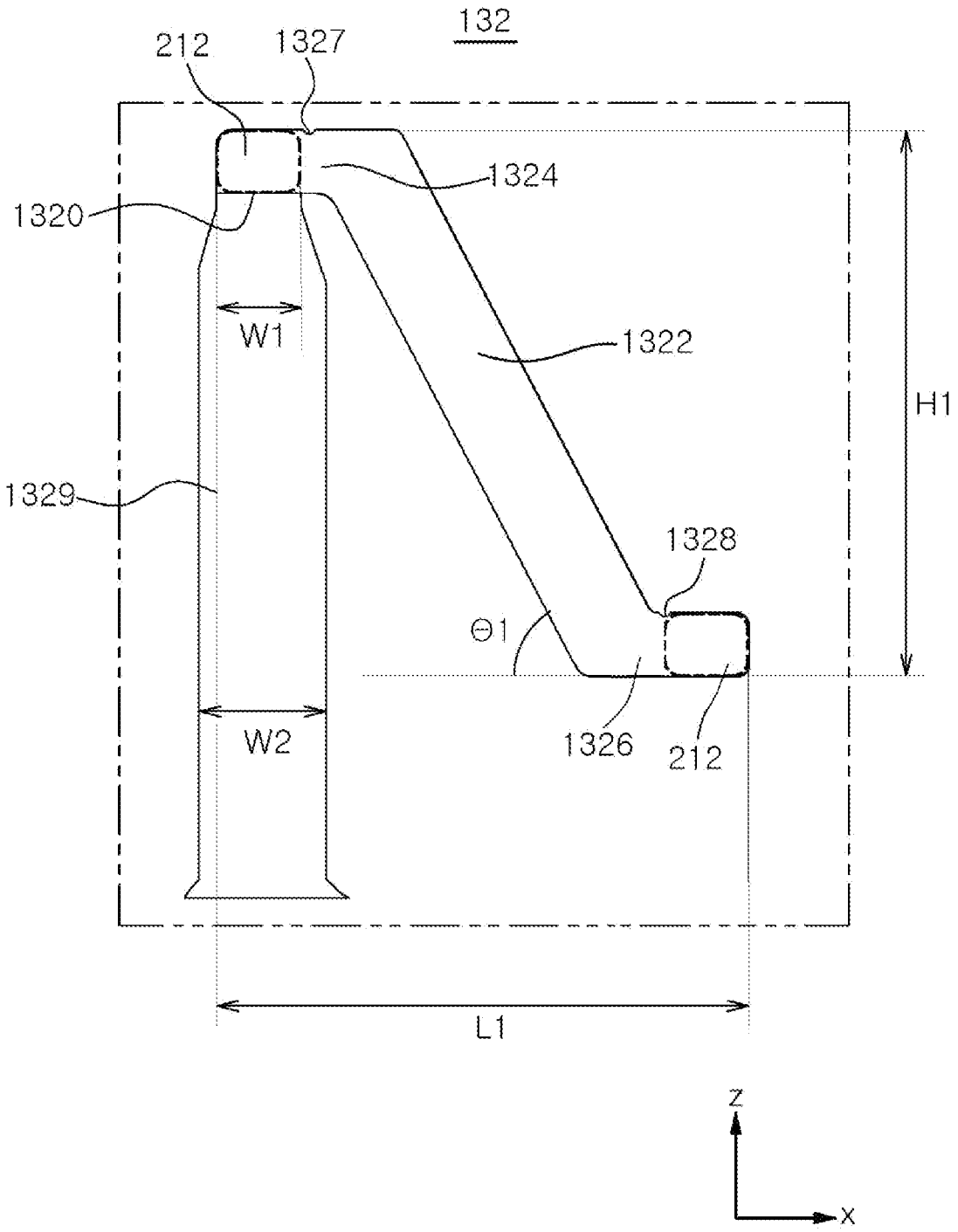
FIG. 7 is a view schematically representing a development view in which one of first guide parts formed in a storage container of FIG. 3 is unrolled.
Figure 8:
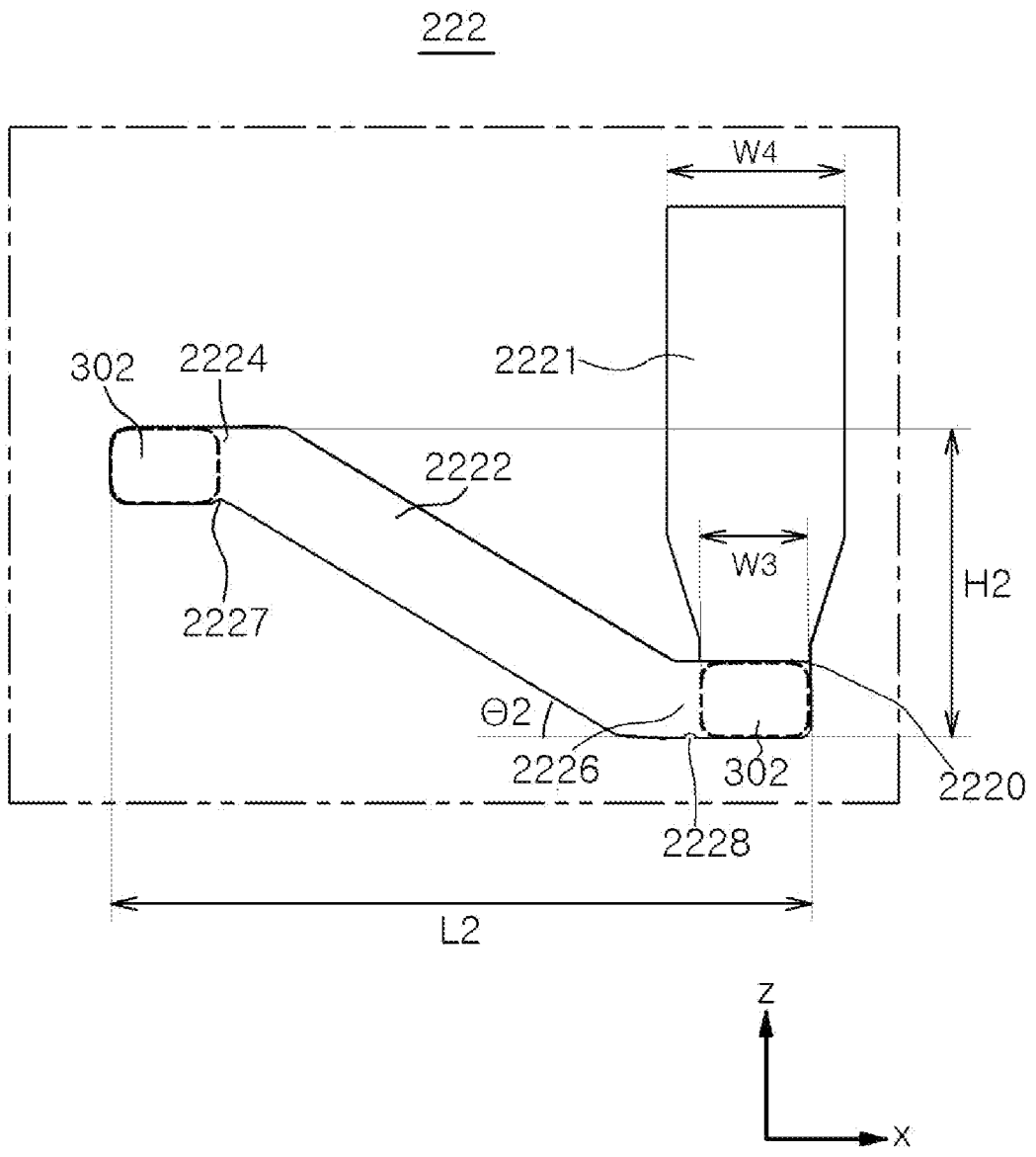
FIG. 8 is a view schematically representing a development view in which a second guide part formed on the inner side of the inner lower part of FIG. 3 is unrolled.

In this connection, it can be understood that the height is measured based on the direction in which the rotation type elevating container 1 extends (a vertical direction, a z-axis direction shown in FIGS. 7 and 8).

The lower side of the inner lower member 220 may be concealed by the outer lower member 210, and the upper side of the inner lower member 220 may be selectively concealed by the upper member 30.

The upper end of the inner lower member 220 may contact the lower end of the rotation prevention part 122, and the second projection insertion part 2221 of the second guide part 222 may be coupled with the rotation prevention part 122 to form a flat surface.

The upper member 30 includes the second projection 302 moving along the second guide part 222 provided on the inner lower member 220 and the coupling member 304 that rotates the storage container 10 by being coupled with the rotation prevention part 122 of the storage container 10.

The second projection 302 is movable along the second guide part 222 formed on the inner lower member 220.

When the second projection 302 is moved along the second guide part 222, the coupling member 304 is coupled with the rotation prevention part 122 to rotate the storage container 10.

The second projection 302 may be formed on the inner side of the upper member 30 as many as the number of the second guide parts 222.

For example, a plurality of second projections 302 may be formed. In this example, the second guide part 222 and the second projection 302 coupled thereto will be each described by way of example as being three in number.

The coupling member 304 may be formed to protrude from the inside of the upper member 30, and may be formed to extend in the vertical direction.

The coupling member 304 can slide with respect to the rotation prevention part 122.

In this example, a pair of coupling members 304 extending in the vertical direction may be coupled to the rotation prevention member 122.

Specifically, one coupling member 304 may be in contact with one side surface 1220 of the rotation prevention part 122, and the other coupling member 304 may be in contact with the other side surface 1220 of the rotation prevention part 122.

In this example, three pairs of coupling members 304 may be provided by way of example, and three pairs of rotation prevention parts 122 corresponding thereto may be provided by way of example.

When the second projection 302 rotates along the second guide part 222 and is moved up, the coupling member 304 can rotate while pushing the side surface 1220 of the rotation prevention part 122. That is, the storage container 10 can be rotated by the upper member 30.

The diameter of the upper member 30 and the diameter of the outer lower member 210 may be provided equal to each other; the diameter of the inner lower member 220 may be formed smaller than the diameter of the outer lower member 210; the diameter of the storage container lower part 130 of the storage container 10 may be formed smaller than that of the inner lower member 220; and the diameter of the storage container middle part 120 of the storage container 10 may become equal to the diameter of the inner lower member 220.

FIG. 7 is a view schematically representing a development view in which one of the first guide parts 132 formed in the storage container 10 of FIG. 3 is unrolled.

Hereinafter, with reference to FIG. 7, the first guide part 132 formed on the outer circumference of the storage container 10 will be described in more detail.

The first guide part 132 that is a path along which the first projection 212 of the lower member 20 is relatively moved may be formed on the outer side of the storage container 10.

The first guide part 132 may include a first inclined path 1322 forming a first angle θ1 with the horizontal plane; a first flat path 1324 extending from one side of the first inclined path 1322 and parallel to the horizontal plane; and a second flat path 1326 extending from the other side of the first inclined path 1322 and parallel to the horizontal plane.

Here, the horizontal plane may be understood as a plane perpendicular to a line extending in the vertical direction (z-axis direction). That is, the horizontal plane may be understood as a plane coincident with the bottom surface (bottom surface of the lower member 20) of the rotation type elevating container 1.

Based on FIG. 7, the z-axis may be understood as the vertical direction, and the x-axis may be understood as a direction in which the horizontal plane is placed.

A first stopper 1327, over which the first projection 212 can be slid-by an external force, may be formed between the first flat path 1324 and the first inclined path 1322.

A second stopper 1328, over which the first projection 212 can be moved sliding by an external force, may be formed between the second flat path 1326 and the first inclined path 1322.

By providing the first stopper 1327 and the second stopper 1328, when a user relatively rotates the lower member 20 and the upper member 30, it is possible to improve a tension feeling of the user rotating the lower member 20.

Additionally, the first guide part 132 may include a first projection insertion part 1329 extending downward from the first flat path 1324.

In order to facilitate the coupling between the first projection 212 of the lower member 20 and the first guide part 132 of the storage container 10, the width W2 of the first projection insertion part 1329 may be formed greater than the width W1 of the projection 212.

The first projection insertion part 1329, the first flat path 1324, the first inclined path 1322, and the second flat path 1326 may be formed as grooves, and the grooves of the first flat path 1324, the first inclined path 1322, and the second flat path 1326 may be formed deeper than the groove of the first projection insertion part 1329.

That is, a first boundary part 1320 may be formed between the first projection insertion part 1329 and the first flat path 1324, and the grooves may be provided in different depths based on the first boundary part 1320.

Since the depth of the first flat path 1324 formed as a groove is formed greater than the depth of the first projection insertion part 1329, the first projection 212 can be prevented from descending along the first projection insertion part 1329 (preventing the separation of the outer lower member 210 and the storage container 10) after the first projection 212 is moved up along the first projection insertion part 1329 and then is positioned in the first flat path 1324.

FIG. 8 is a view schematically representing a development view in which the second guide part 222 formed on the inner side of the inner lower part 220 of FIG. 3 is unrolled.

Hereinafter, with reference to FIG. 8, the second guide part 222 formed on the outer side of the inner lower member 220 will be described in more detail.

A second guide part 222 that is a path along which the second projection 302 of the upper member 30 is moved may be formed on the outer side of the second guide part 222.

The second guide part 222 may include a second inclined path 2222 forming a second angle θ2 with the horizontal plane; a third flat path 2224 extending from one side of the second inclined path 2222 and parallel to the horizontal plane; and a fourth flat path 2226 extending from the other side of the second inclined path 2222 and parallel to the third flat path 2224.

A third stopper 2227, over which the second projection 302 can be moved sliding by an external force, may be formed between the third flat path 2224 and the second inclined path 2222.

A fourth stopper 2228, over which the second projection 302 can be moved sliding by an external force, may be formed between the fourth flat path 2226 and the second inclined path 2222.

By providing the third stopper 2227 and the fourth stopper 2228, when a user relatively rotates the lower member 20 and the upper member 30, it is possible to improve a tension feeling of the user rotating the upper member 30.

Additionally, the second guide part 222 may include a second projection insertion part 2221 extending upward from the fourth flat path 2226.

In order to facilitate the coupling between the second projection 302 of the upper member 30 and the second guide part 222 of the inner lower member 220, the width W4 of the second projection insertion part 2221 may be formed greater than the width W3 of the second projection 302.

The second projection insertion part 2221, the second inclined path 2222, the third flat path 2224, and the fourth flat path 2226 may be formed as grooves.

The grooves of the second inclined path 2222, the third flat path 2224, and the fourth flat path 2226 may be formed deeper than the groove of the second projection part 2221.

That is, a second boundary part 2220 may be formed between the second projection insertion part 2221 and the fourth flat path 2226, and the grooves may be provided in different depths based on the second boundary part 2220.

Since the depth of the fourth flat path 2226 formed as a groove is formed greater than the depth of the second projection insertion part 2221, the second projection 302 can be prevented from ascending along the second projection insertion part 2221 (preventing the separation of the lower member 20 and the inner lower part 220) after the second projection 302 descends along the second projection insertion part 2221 and then is positioned in the fourth flat path 2226.

Next, the shapes of the first guide part 132 formed on the storage container 10 and the second guide part 222 formed on the lower member 20 will be described with reference to FIGS. 7 and 8.

As described above, the storage container 10 is provided with the first guide part 132 which is slidably moved in contact with the first projection 212 of the lower member 20, and the lower member 20 is provided with a second guide part 222 that is a path along which the second projection 302 of the upper member 30 is moved.

The first guide part 132 includes a first inclined path 1322 forming a first angle θ1 with the horizontal plane, and the second guide part 222 has a second inclined path 2222 forming a second angle θ2 with the horizontal plane.

In this regard, the first angle θ1 of the first inclined path 1322 may be formed greater than the second angle θ2 of the second inclined path 2222.

When the second projection 302 of the upper member 30 rotates with respect to the second guide part 222 of the inner lower member 220 by the second length L2, the upper member 30 can be moved up by the second height H2.

Additionally, when the upper member 30 is rotated with respect to the inner lower member 220 by the second length L2, the storage container 10 can also be rotated by the second length (L2) by the rotation prevention part 122 of the storage container 10 coupled to the coupling member 304 of the upper member 30.

When the storage container 10 is rotated by the second length L2, the first guide part 132 of the storage container 10 can be rotated relative to the first projection 212 of the lower member 20 by the first length L1 (the first length L1 and the second length L2 are the same). At this time, the storage container 10 may be moved up by the first height H1.

That is, when the upper member 30 and the storage container 10 are rotated by the same angle with respect to the lower member 20 (moved by the first length L1 and the second length L2 on the development view), the upper member 30 is moved by the second height H2, and the storage container 10 is moved by the first height H1 greater than the second height H2.

With this configuration, when the upper member 30 and the storage container 10 are rotated by the same angle with respect to the lower member 20, the height which the storage container 10 is moved up to or down from can be greater than the height which the upper member 30 is moved up to or down from.

That is, since the storage container 10 is moved up higher than the upper member 30 from the first state in which it is concealed from the outside by the upper member 30, the storage container upper part 110 is exposed to the outside to create a state in which the user can press the storage container upper part 110 (second state). At this time, since the portion of the inner lower member 220 provided of a transparent material is exposed, the contents stored in the storage container 10 can be observable from the outside (see FIG. 10).

Figure 9:
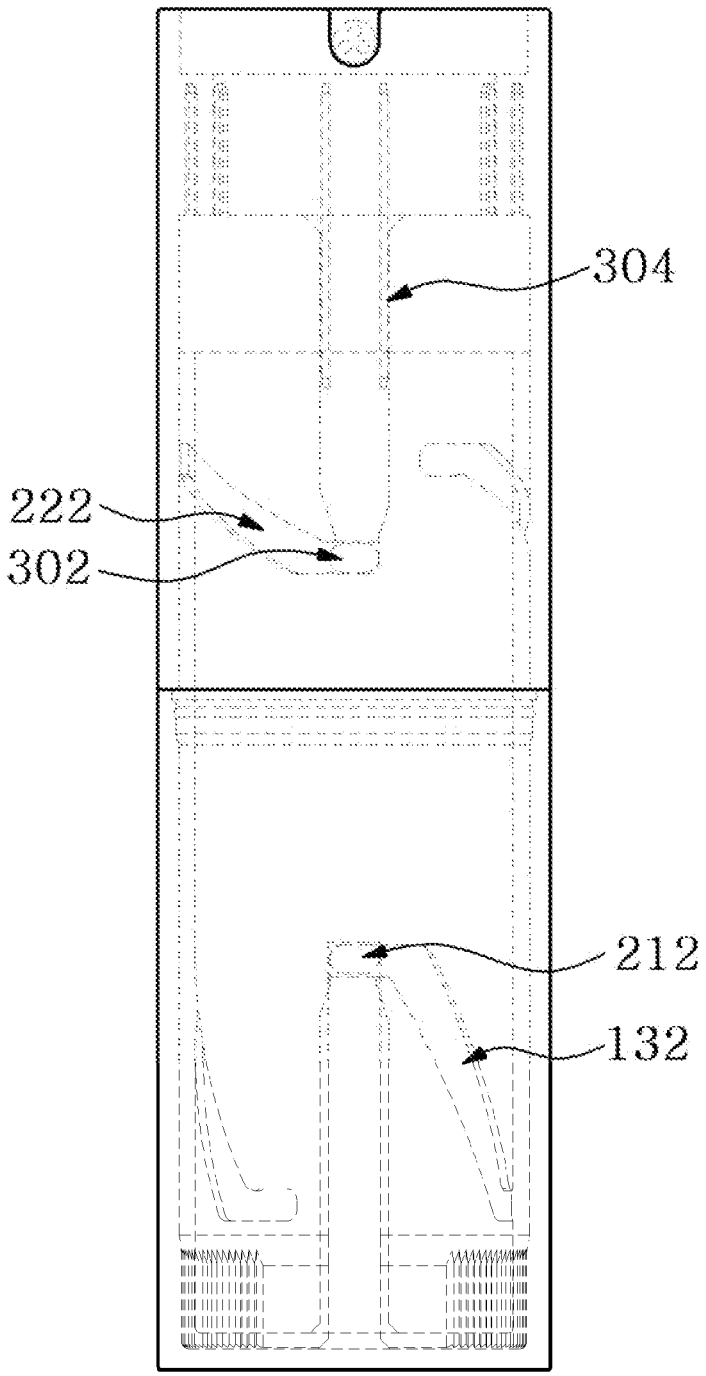
FIG. 9 is a view representing a first state in which the storage container of the rotation type elevating container in FIG. 1 is concealed from the outside.

Additionally, since the storage container 10 is moved down more than the upper member 30 from the second state, the storage container 10 is concealed by the upper member 30 and the lower member 20 (first state) (see FIG. 9).

FIG. 9 is a view representing a first state in which the storage container 10 of the rotation type elevating container 1 in FIG. 1 is concealed from the outside.

Figure 10:
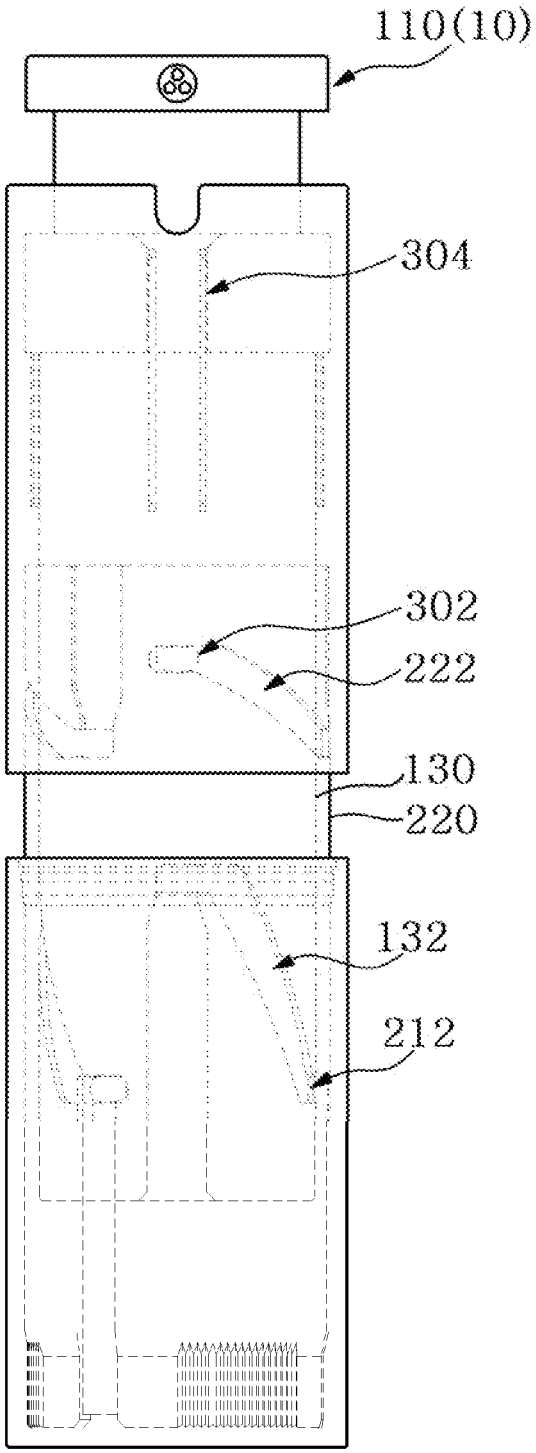
FIG. 10 is a view representing a second state in which a portion of the storage container of the rotation type elevating container in FIG. 1 is observable from the outside.

FIG. 10 is a view representing a second state in which a portion of the storage container 10 of the rotation type elevating container 1 in FIG. 1 is observable from the outside.

Hereinafter, with reference to FIGS. 1 to 10, a method for operating a rotation type elevating container will be described in detail.

First, an operation method by which the first state in which the storage container 10 is concealed from the outside (see FIG. 9) is changed to the second state in which a portion of the storage container 10 is observable from the outside (see FIG. 10) will be described.

According to an example of the present disclosure, the method for operating a rotation type elevating container may include a step of the second projection 302 of the upper member 30 being rotated and being moved up along the second guide part 222 of the lower member 20 (step S1); and a step of the first guide part 132 of the storage container 10 being supported by and moved up along the first projection 212 provided on the lower member 20 as the upper member 30 rotates the storage container 10 (step S2).

In this regard, the height by which the storage container 10 is moved up may be formed greater than the height by which the upper member 30 is moved up.

First, the step of the second projection 302 of the upper member 30 being rotated and being moved up along the second guide part 222 of the lower member 20 (step S1) will be described in detail as below.

When the user relatively rotates the outer lower member 210 and the upper member 30 while holding the outer lower member 210 with one hand and the upper member 30 with the other hand, the second projection 302 can be moved along the second guide part 222.

Specifically, the second projection 302 can be moved from the fourth flat path 2226 to the second inclined path 2222 and then to the third flat path 2224.

This allows the upper member 30 to be rotated and moved up relative to the lower member 20.

Next, the step of the first guide part 132 of the storage container 10 being supported by and moved up along the first projection 212 provided on the lower member 20 as the upper member 30 rotates the storage container 10 (step S2) will be described in detail as below.

Specifically, the coupling member 304 of the upper member 30 can be coupled to the rotation prevention part 122 of the storage container 10 to rotate the storage container 10.

At this time, the first guide part 132 disposed on the lower side of the storage container 10 is supported by the first projection 212, so the storage container 10 is rotated and moved up.

More specifically, as the storage container 10 is rotated, the first projection 212 may be relatively moved along the first flat path 1324, the first inclined path 1322, and the second flat path 1326.

In other words, as the storage container 10 is rotated, the first guide part 132 may be supported and moved up by the first projection 212.

Similarly, an operation method by which the second state in which a portion of the storage container 10 is observable from the outside (see FIG. 10) is changed to the first state in which the storage container 10 is concealed from the outside (see FIG. 9) may be understood in the inverse order to the above description.

Specifically, the method for operating a rotation type elevating container may include a step of the second projection 302 of the upper member 30 being rotated and being moved down along the second guide part 222 of the lower member 20 (step S140); and a step of the first guide part 132 of the storage container 10 being supported by and moved down along the first projection 212 provided on the lower member 20 as the upper member 30 rotates the storage container 10 (step S2').

In this regard, the height by which the storage container 10 is moved down may be formed greater than the height by which the upper member 30 is moved down.

Hereinafter, a relative movement relationship among the storage container 10, the lower member 20, and the upper member 30 will be described.

The storage container 10 and the upper member 30 can be relatively movable up and down, but cannot be relatively rotatable.

The storage container 10 and the lower member 20 can be relatively movable up and down, and can be relatively rotatable.

The lower member 20 and the upper member 30 can be relatively movable up and down, and can be relatively rotatable.

Hereinafter, a method for assembling the rotation type elevating container 1 will be described.

The method for assembling the rotation type elevating container 1 may include fixing the outer lower member 210 and the inner lower member 220 (step S10); inserting a portion of the storage container 10 into the inside of the inner lower member 220 (step S20); inserting the upper member 30 to the outside of the inner lower member 220 (step S30); and coupling the storage container upper part 110 to the storage container middle part 120 (step S40).

First, the step of fixing the outer lower member 210 and the inner lower member 220 (step S10) will be described in detail as below.

The outer lower member 210 and the inner lower member (220) can be combined by press-fitting the first fixing part 214 formed on the lower side of the outer lower member 210 and the second fixing part 224 formed on the lower side of the inner lower member 220.

At this time, the first projection 212 can be moved along the coupling slit 226.

Next, the step of inserting a portion of the storage container 10 into the inside of the inner lower member 220 (step S20) will be described in detail as below.

When the storage container 10 is inserted into the inner lower member 220, the first projection can be seated on the first flat path 1324 after being moved from the lower side to the upper side of the first projection insertion part 1329 of the first guide part 132.

In this case, the depth of the first flat path 1324 is formed deeper than that of the first projection insertion part 1329 with the first boundary part 1320 as the boundary, so the first projection 212 can be caught by the first boundary part 1320.

Next, the step of inserting the upper member 30 to the outside of the inner lower member 220 (step S30) will be described in detail as below.

When inserting the upper member 30 to the outside of the inner lower member 220, the second projection 302 may be moved downward along the second projection insertion part 2221 of the second guide part 222 after being inserted into the rotation prevention part 122, and be seated on the fourth flat path 2226.

In this case, the depth of the fourth flat path 2226 is formed deeper than that of the second projection insertion part 2221 with the second boundary part 2220 as the boundary, so the second projection 302 can be caught by the second boundary part 2220.

Next, the step of coupling the storage container upper part 110 to the storage container middle part 120 (step S40) will be described in detail as below.

In step S20, the storage container 10 is inserted into the inner lower member 220 with the storage container upper part 110 being separated from the storage container middle part 120.

Then, by combining the storage container upper part 110 and the storage container middle part 120, the rotation type elevating container 1 can be assembled.

While until now the rotation type elevating container 1, the method for operating a rotation type elevating container, and the method for assembling a rotation type elevating container according to an example of the present disclosure have been described as specific embodiments, these are just exemplary embodiments, and the present disclosure should be construed in a broadest scope based on the fundamental technical ideas disclosed herein, rather than as being limited to them. By combining or replacing a part or parts of embodiments disclosed herein, the ordinary skilled in the art may carry out an embodiment which is not explicitly described herein, and however, it should be noted that it shall not depart from the scope of the patent right of this disclosure. Besides, the ordinary skilled in the art may easily change or modify embodiments disclosed herein based on this disclosure, and however, it is obvious that such changes or modifications also fall within the scope of the patent right of this disclosure.

REFERENCE SIGN LIST

| | |
|---|---|
| 1: | rotation type elevating container |
| 10: | storage container |
| 110: | storage container upper part |
| 120: | storage container middle part |
| 130: | storage container lower part |
| 132: | first guide part |
| 20: | lower member |
| 210: | outer lower member |
| 212: | first projection |
| 220: | inner lower member |
| 222: | second guide part |
| 224: | second fixing part |
| 30: | upper member |
| 302: | second projection |

What is claimed is:

1. A rotation type elevating container comprising:

a storage container configured to store a content;

a lower member accommodating a lower portion of the storage container; and an upper member accommodating an upper portion of the storage container and provided to be movable relative to the lower member, wherein the upper member and the storage container are configured to be rotated by a same angle with respect to the lower member in such a way that a distance by which the storage container is moved in a vertical direction is greater than a distance by which the upper member is moved in a vertical direction, and wherein the lower member includes an outer lower member provided with a first projection in contact with a portion of the storage container; and an inner lower member provided with a second guide part for guiding a second projection of the upper member.

2. The rotation type elevating container of claim 1, wherein the storage container includes:

a storage container upper part provided with a discharging hole through which the content is to be discharged;

a storage container middle part provided with a rotation prevention part configured to prevent a rotation of the storage container relative to the upper member; and a storage container lower part provided with a first guide part which is slid in contact with the first projection of the outer lower member.

3. The rotation type elevating container of claim 1, wherein an outer side of the storage container is provided with a first guide part that is a path along which the first projection of the outer lower member is moved, and wherein the first guide part includes a first inclined path forming a first angle with a horizontal plane; a first flat path extending from one side of the first inclined path and parallel to the horizontal plane; and a second flat path extending from another side of the first inclined path and parallel to the first flat path.

4. The rotation type elevating container of claim 1, wherein the second guide part includes:

a second inclined path forming a second angle with a horizontal plane;

a third flat path extending from one side of the second inclined path and parallel to the horizontal plane; and a fourth flat path extending from another side of the second inclined path and parallel to the third flat path.

5. The rotation type elevating container of claim 1, wherein the storage container is provided with a first guide part with which the first projection of the outer lower member is slid in contact, wherein the lower member is provided with the second guide part that is a path along which the second projection of the upper member is moved, wherein the first guide part includes a first inclined path forming a first angle with a horizontal plane, and the second guide part has a second inclined path forming a second angle with a horizontal plane, and wherein the first angle is provided greater than the second angle.

6. The rotation type elevating container of claim 1, wherein at least a portion of the inner lower member is provided in a transparent material.

7. The rotation type elevating container of claim 1, wherein a first fixing part provided as a plurality of slits is formed on the inner side of the outer lower member, wherein a second fixing part provided as a plurality of slits is formed on the outer side of the inner lower member, and wherein the first fixing part and the second fixing part are coupled so that the outer lower member and the inner lower member are relatively fixed.

8. The rotation type elevating container of claim 1, wherein the inner lower member includes a second guide part for guiding the movement of the upper member.

9. The rotation type elevating container of claim 1, wherein the upper member includes:

a second projection which is moved along a second guide part provided on the inner lower member; and a coupling member that rotates the storage container by being coupled with a rotation prevention part of the storage container.

10. A method for operating a rotation type elevating container including a storage container configured to store a content, a lower member accommodating a lower portion of the storage container, and an upper member accommodating an upper portion of the storage container and provided to be movable relative to the lower member, the method comprising:

sliding a second projection of the upper member to be moved up along a second guide part of the lower member (step S1); and supporting a first guide part of the storage container with a first projection provided on the lower member to be moved up as the upper member rotates the storage container (step S2), wherein a distance by which the storage container is moved up is provided greater than a distance by which the upper member is moved up, and wherein the lower member includes an outer lower member provided with a first projection in contact with a portion of the storage container; and an inner lower member provided with a second guide part for guiding a second projection of the upper member.

11. The method of claim 10, wherein the step S1 includes moving the second projection along the second guide part having a second angle, wherein the step S2 includes moving a first inclined path having a first angle while supporting the first inclined path with the first projection, and wherein the first angle is formed greater than the second angle.

* * * * *